United States Patent [19]

Lendvay

[11] 4,274,427

[45] Jun. 23, 1981

[54] METHOD OF INCREASING FILLING POWER OF TOBACCO PRODUCTS

[75] Inventor: Andrew T. Lendvay, Richmond, Va.

[73] Assignee: Philip Morris Incorporated, New York, N.Y.

[21] Appl. No.: 938,118

[22] Filed: Aug. 30, 1978

[51] Int. Cl.[3] ..... A24B 3/18

[52] U.S. Cl. ..... 131/293; 131/903

[58] Field of Search ..... 131/140 P, 140 C, 17, 131/140 B, 2, 15 R, 15 C

[56] References Cited

U.S. PATENT DOCUMENTS

| | | | |
|---|---|---|---|
| 3,425,425 | 2/1969 | Hind | 131/140 P |
| 3,513,857 | 5/1970 | Silberman | 131/140 P |

*Primary Examiner*—V. Millin

*Attorney, Agent, or Firm*—Watson, Leavenworth, Kelton & Taggart

[57] ABSTRACT

Through interaction with the pectinaceous materials of tobacco smoking products, increased filling power of tobacco constituents is accomplished, in accordance with the present invention, by means of maintaining the tobacco, usually in shredded form, in an expanded form by applying, in solution thereto, multivalent metal and organic acid salts, especially those salts found in the hydrated form. The multivalent salt additives cause the pectinaceous materials of the tobacco to retain the expanded bulk volume of the tobacco.

34 Claims, No Drawings

METHOD OF INCREASING FILLING POWER OF TOBACCO PRODUCTS

BACKGROUND OF THE INVENTION

1. Field of the Invention

The present invention relates to tobacco smoking products and more particularly to increasing the filling power of the tobacco filler constituents of a smoking product through the addition of a solution of the ions of multivalent metal or organic acid salts, which interact with the pectinaceous substances of the tobacco to stiffen and to firmly bind said pectinaceous substances to maintain an expanded form.

2. Description of the Prior Art

It is desirable to increase the filling power of tobacco products so that a consequent reduction in the total amount of tobacco utilized, such as in a tobacco rod, is comparatively realized. Since the filling power is often realized through the use of tobacco constituents, including reconstituted tobacco, which are found in shredded form, it is desired that the filler tobacco assume an expanded bulk volume which is retained over long periods of time such that, after casing, the firmness of the tobacco rod, as packed, will not be lost.

Included among the approaches to increasing the filling power of tobacco, to cause the tobacco to assume and to retain an expanded physical state, are processes which cause cellular expansion such as puffing, or flash heating, freeze-drying and modifications thereof. Results of up to a two fold increase in filling power by these methods are not uncommon; however, the puffing and freeze-drying processes require relatively extreme conditions which, if not carefully controlled, may impair the subjective smoking quality of the tobacco.

The freeze-drying process, especially, as illustrated by U.S. Pat. No. 3,710,802 to William H. Johnson and British Pat. Specification No. 1,293,735 to American Brands, Inc., requires the utilization of extensive apparati in a multi-step process which includes, for example, means for controlling atmospheric pressure during the final sublimation stage. Puffing, the application of high pressure steam followed by a sudden release of pressure, does not necessarily assure that the tobacco constituents will retain the expanded form, as noted by de la Burde, et al., U.S. Pat. No. 3,556,112. Loss of the expanded state and firmness over time is due to plasmolysis and cell contraction, occurring during drying stages, which tend to cause expanded tobacco to return to its original form.

Other patents to de la Burde relating to expansion of tobacco stems by utilizing heat treatment or microwave energy are U.S. Pat. Nos. 3,409,022, 3,409,023, 3,409,027 and 3,409,028. U.S. Pat. No. 3,734,104 to William M. Buchanan et al., also relates to a process for the expansion of tobacco stems.

A variation of puffing, the impregnation in and subsequent release of organic solvents from the tobacco to increase the bulk volume, requires that substantially all of the organic solvent has been removed from the expanded tobacco since these substances may adversely affect the subjective smoking quality of the tobacco. Examples of using a volatile organic liquid, such as a halogenated hydrocarbon, are U.S. Pat. No. 3,524,452 to Glen P. Moser et al., and U.S. Pat. No. 3,524,451 to James D. Frederickson.

Additional methods of expansion include the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco. The tobacco impregnated therewith is heated or the pressure thereon is reduced to thereby expand the tobacco. Gases which react to form solid chemical reaction products within the tobacco, have also been utilized to expand tobacco. The solid reaction products may then be decomposed by heat to produce gases within the tobacco which cause expansion of the tobacco upon the release of the gas.

U.S. Pat. No. 1,789,435, granted in 1931, to Wilford J. Hawkins, describes a method and apparatus for expanding the volume of tobacco in order to make up the loss of weight caused in curing tobacco leaf. To accomplish this object, the cured and conditioned tobacco is contacted with a gas, which may be air, carbon dioxide or steam under about 20 pounds of pressure and the pressure is then releived, whereby the tobacco tends to expand. The patent states that the volume of tobacco may, by that process, be increased to the extent of about 5–15%.

An alien property custodian document No. 304,214 to Joachim Bohme, dated 1943, indicates that tobacco can be expanded using a high-frequency generator. There are limitations to the degree of expansion which can be achieved without affecting the subjective smoking quality of the tobacco.

A publication in the "Tobacco Reporter" of November 1969 by P. S. Meyer summarized tobacco puffing and expansion procedures, investigations of expanding and manipulating tobacco for purposes of reducing costs and means for reducing the "tar" content by reduction. Mention is made in this publication of puffing tobacco by different procedures including the use of halogenated hydrocarbons, low pressure or vacuum operation, or high pressure steam treatment that causes leaf expansion from inside the cell when outside pressure is suddenly released.

South African applications Nos. 70/8291 and 70/8292 to R. J. Reynolds Tobacco Company, both filed in 1970, relate to tobacco expansion employing chemical compounds which decompose to form a gas or employing inert solutions of a gas under pressure to maintain the gas in solution until it impregnates the tobacco.

A patent to Robert G. Armstrong et al., U.S. Pat. No. 3,771,533, involves a treatment of tobacco with carbon dioxide and ammonia gases, whereby the tobacco is saturated with these gases and ammonium carbonate is formed in situ. The ammonium carbonate is thereafter decomposed by heat to release the gases within the tobacco cells and causes expansion of the tobacco.

A patent to Frank J. Sowa, U.S. Pat. No. 2,596,183, granted in 1952, sets forth a method for increasing the volume of shredded tobacco by adding additional water to the tobacco to cause the tobacco to swell. Thereafter, the moisture-containing tobacco is heated, whereby the moisture evaporates and the resulting moisture vapor causes expansion of the tobacco.

The present invention, in comparison with prior art methods of increasing filling power, achieves an increased filling power on the order of 10 to 25%, by means of the utilization of an efficient and economical one-step process. The additive multivalent salt, after a drying step, maintains the tobacco in expanded form. Further, the solution of the multivalent metal or organic acid salt is applied to the total tobacco filler constituent blend. Other methods of expansion do not generally involve expanding all of the tobacco of a particular smoking blend or product. Instead, generally only part of the tobacco filler for a particular blend is expanded. This expanded tobacco is then added with more dense unexpanded tobacco. The present invention assures a uniform blend since the entire blend, composed of shredded tobacco constituents, is treated and expanded.

Frankenberg, in U.S. Pat. Nos. 2,598,680, 2,955,601, and 2,706,695 utilized water swelling clays, preferably bentonite, or water-soluble derivatives of cellulose to improve the cohesiveness and homogeneity of sheets of shredded tobacco products, while yet maintaining the subjective smoking quality thereof.

It will be noted that, in U.S. Pat. No. 2,598,608, multivalent metals may be utilized, but in minute amounts, to make the binding agent soluble. In U.S. Pat. No. 2,955,601, Frankenberg teaches the use of the salts of organic acids, in combination with a non-salt cellulose binding agent, for coloring purposes. Finally, Frankenberg in U.S. Pat. No. 2,706,695 utilized cellulose with a silicious mineral type material which acts as a catalyst to promote combustion of undesired components of smoke through the use of mineral type materials, including clays and silicates, which have active hydrogen atoms.

Many acids and salts have been utilized in the art for purposes similar to the later Frankenberg patent, primarily to combat, by combustion, the undesired alkaline by-products in the smoke of combustion. For example Sutter, U.S. Pat. No. 2,172,946 utilized natural acids to combat the undesirable effects of smoke alkalinity. Jones, U.S. Pat. No. 2,766,145 utilized esters which, upon combustion, would yield flavoring organic carboxylic acids.

Tyrer, et al., U.S. Pat. No. 2,914,072 utilized metallic and organic salts in combination, as catalysts, to promote greater combustion and thermal destruction of the undesirable alkaline, especially nicotine-base alkaline, by-products found in the smoke. Tyrer, et al., further noted that use of sulfates is particularly undesirable since the purpose of the invention was to promote combustion. Sowa, U.S. Pat. No. 2,429,567, teaches a method of denicotinizing tobacco by means of utilizing salts, especially chloride salts, to bind with the nicotine released upon burning. Sowa also noted that sulfates, such as zinc sulfate, are undesirable due to the fact the sulfates readily oxidize and do not bind the nicotine.

Other references which have utilized multivalent metals or acids by one means of another to improve the flavor of the tobacco by binding acids and/or bases of the smoke of combustion include Thoms, U.S. Pat. No. 757,514 and Lowenthal, U.S. Pat. No. 2,029,494.

Use of an aluminous additive was made in Haden, U.S. Pat. No. 2,941,755 to lower tar and to improve flavor. Parmalee, U.S. Pat. No. 3,112,755 incorporated citric acid into the tobacco to help prevent the cilia of the lungs from being clogged by the smoke. Of additional interest is Endemann, U.S. Pat. No. 430,516, wherein aluminum sulfate is utilized in the making of paper pulp from tobacco by-products.

Hind, U.S. Pat. No. 3,425,425, however, illustrates the use of an additive prior to puffing. The additive is preferably a water-soluble carbohydrate or mono- or polysaccharide. Sodium or potassium addition salts of organic or inorganic acids such as citric and malic acid or hydrated magnesium sulfate may be a further additive to impart improved flavor.

The process of the present invention to increase the filling power of tobacco is simple and economical and does not alter the subjective smoking quality of the tobacco products, even though the additives of the present invention remain in the tobacco. It has also been determined that the addition salts of the present invention have no deleterious effects upon the smoker. These and other advantages and features will become apparent in light of the following summary, description and examples of the present invention.

SUMMARY OF THE INVENTION

The present invention comprehends the utilization of a solution of the ions of the salt a multivalent metal or organic acid, to increase the filling power of tobacco products. The salts herein disclosed may be utilized individually or in combination. Through interaction with the pectinaceous materials of the tobacco, the aforesaid additive salt solutions cause, upon drying, the retention of the expanded form of the tobacco by stiffening and firmly binding the expanded pectinaceous fibers of the tobacco.

The salts of the multivalent metals found to be effective in cross-linking pectinaceous materials include the salts of the alkaline earth metals, metals of the periodic table transition series and combinations of these with the alkali metals, including for example, aluminum, calcium, magnesium, titanium, zinc, chromium, manganese, molybdenum, nickel, tin, and iron.

The acids of which the salts thereof have been found to be effective include malonic, malic, tartaric, adipic, lactic, glycolic, fumaric, ascorbic, aspartic, glumatic, sulfamic, formic, gallic, phosphoric, citric, oxalic, succinic, tannic and sulfamic.

Salts found to be particularly effective are aluminum sulfate salts, especially those found in hydrated forms, such as ammonium aluminum sulfate, $NH_4Al(SO_4)_2.12H_2O$, potassium aluminum sulfate, $KAl(SO_4)_2.12H_2O$ and aluminum sulfate, $Al_2(SO_4)_3.18H_2O$, or combinations thereof. Hydrated salts of organic acids such as potassium titanium oxalate, $K_2TiO(C_2O_4)_2.2H_2O$, are also particularly effective. It will be noted that the sulfate salts of aluminum occur in forms ranging from anhydrous to forms which contain 27 molecules of water, therefore, the examples herein are merely illustrative of the usage of the aluminum sulfates and are not intended to limit the invention to any particular form.

The present invention further provides an economical and efficient method of expanding and retaining the bulk of shredded tobacco constituents under mild conditions. The method may be utilized as a substantially one-step process in a casing stage. The multivalent additives need not be removed from the tobacco after the treatment.

These and other features and advantages of the present invention will become apparent in the following description of the preferred embodiment and examples thereof.

DESCRIPTION OF THE PREFERRED EMBODIMENT

The additives of the present invention are applied under mild conditions in solution, usually an aqueous solution, to contact substantially with the tobacco, which is usually in a form shredded to filler dimensions.

This is merely followed by a drying stage to remove the solvent. For reasons of efficiency and economy, the process may be carried out during the casing process, rather than at some point prior to casing, by methods known in the art for the incorporation of specified amounts of additives, although there is no requirement that the application be so limited. The additives are dissolved or dispersed in an appropriate solvent and may be applied, therefore, as a spray before, during or after casing.

Amounts of the multivalent metal or acid salt applied to the tobacco products may range from 0.2% to 7.5% of dry tobacco weight to produce significant increases in filling power. A preferred range is from 1.0% to 4.0% of dry tobacco weight. A 3% by weight chemical addition appears to provide the best result. Levels greater than 7.5% by weight appear to have a tendency to affect the subjective smoking value or flavor of the tobacco products. Levels less than 0.2% do not appear to provide worthwhile filling power increases.

It is believed that upon addition of the solution of the multivalent metal or acid salt, expansion of the tobacco product takes place by means of the solvent and, upon drying, the various salts and ions thereof have bound to the pectinaceous materials, to stiffen the pectins, and prevent the return of the tobacco to its original unexpanded form. The pliability of individual shreds is reduced, therefore, fewer treated and stiffened tobacco shreds are needed to fill the space with equal firmness as compared to untreated shreds.

It is, therefore, an object to obtain a filler having increased bulk volume. By utilizing a lesser absolute amount of tobacco, it is an object to produce, for example, a firm tobacco rod, which favorably compares with the firmness and subjective smoking qualities of identical tobacco rods which have not been treated in accordance with the teaching of the present invention. It is desired to achieve an overall tobacco savings in the range of 5–15% due to an increase of filling power of 5–25%.

In comprehending the following examples, it is to be understood that the filling power is measured as the minimum weight of the material which will produce a tobacco rod of specified dimensions and firmness. The filling power is the ability of the material to provide a firm rod. The filling power may be measured as the volume occupied by a specified weight of filler in an upright cylinder while a specified piston weight is applied to its top surface, as set forth in "Filling Volume of Cut Tobacco and Cigarette Hardness," H. Wakeham, et al., Tobacco Science xx: 164–167, 1976. Standard equilibrium conditions for measurement of filling power is usually 60% relative humidity (RH) at 75° F. (23.9° C.).

Further it is to be understood throughout the following examples that the oven volatiles (OV) measurement is the standard weight loss in circulating air oven in three hours at 100° C. The cylinder volume (CV) measurement of filling power, is determined by placing 10.0 grams of filler in a standard metal cylinder, 3.358 cm. in diameter, and then by compressing the same, by vibration, under a piston weighing 1875 grams having a diameter of 3.335 cm. This vibrating compression continues for one-half (0.5) minute(s) and then is followed by still compression for five (5.0) minutes. The volume reading is then taken. The standard deviation of the cylinder volume measurement is about 1.5%.

In the following examples, unless otherwise noted, the sample has been previously conditioned to equilibrium at 24° C. and 60% RH.

EXAMPLE 1

Two samples of a cigarette filler blend were sprayed after casing with 2% and 5% respectively, by weight, of $Al_2(SO_4)_3.18H_2O$ which had been dissolved in water to give an approximately 50% aqueous solution. The filler was dried at room temperature for 4 days and conditioned at 24° C. and 60% RH. Comparative measurements, illustrated in Table 1, indicated a filling power increase of about 20% for the tobacco treated with the 5% salt and about a 10% increase for the tobacco treated with the 2% salt.

TABLE 1

| | CV cc/10 g | OV % |
|---|---|---|
| Control | 33.7 | 12.7 |
| Experimental, 5% | 40.7 | 11.6 |
| Experimental, 2% | 37.2 | 12.7 |

EXAMPLE 2

Three samples of cut, uncased tobacco filler shreds were sprayed with varying levels of aluminum sulfate, by means of an aqueous solution of aluminum sulfate. After drying, the samples were analyzed for aluminum sulfate concentration and OV and CV values were measured.

TABLE 2

| | % $Al_2(SO_4)_3 . 18H_2O$ | CV cc/ 10 g | OV % | CV % increase |
|---|---|---|---|---|
| Control | — | 37.6 | 14.8 | — |
| Experimental | 4.32 | 43.8 | 14.0 | 20 |
| Experimental | 6.05 | 44.3 | 14.5 | 21 |
| Experimental | 6.69 | 46.1 | 14.4 | 26 |

EXAMPLE 3

Cigarettes were prepared at three weight levels, using a commercial tobacco blend treated with $Al_2(SO_4)_3.16H_2O$ being 2.8% of dry tobacco weight, in the casing. Comparisons were made with cigarettes of similar weight levels prepared with the same commercial tobacco blend which was untreated.

One-half of the treated and untreated cigarettes were selected for equal weight in each category for the determination of rod firmness by means of a compacimetric test. Due to the volume increase in the treated filler, a 7.3% weight reduction was possible at equal firmness. Due to the 2.8% salt in the filler, the true tobacco saving was 9.9% compared with the non-treated cigarette at equal rod firmness.

The other half of the cigarettes underwent accelerated aging for three weeks by alternated placement of the cigarettes in a cabinet under conditions of 110° F. and 15% RH and in another cabinet under conditions of 100° F. and 90% RH. After aging, the firmness of the cigarettes was determined in the same manner as above. The volume increase, as well as the firmness of the treated cigarettes, proved to be stable. Comparisons were made at equal firmness and at equilibrium moisture of the treated and untreated cigarettes. A 6.8% weight reduction, comparable to that of the of the non-aged, treated cigarettes, was achieved in the aged, treated cigarettes, consideration being made for the exchange of salt for tobacco. The true tobacco saving in cigarettes that underwent accelerated aging was 9.4% compared with the non-treated cigarette at equal rod firmness.

EXAMPLE 4

Cigarettes were prepared by machine with a control tobacco, one portion being untreated and another portion of the same tobacco being treated with 3% by weight of aluminum sulfate. Conventional filters were attached. These were presented to an experienced panel of smokers in paired comparison. Though there was no significant preference, the panel found the untreated cigarette harsher at a 99.9 level of significance. The panel further found the untreated cigarettes more spicy, more bitter and hotter at a 99 level of significance.

EXAMPLE 5

The cigarette tobacco filler blend used in Example 1 was treated with a 3.0%, by dry weight, salt combination composed of 0.75% potassium aluminum sulfate, 0.75% ammonium aluminum sulfate, and 1.5% aluminum sulfate. After equilibration, the following results were obtained:

| | Control | Treated |
|---|---|---|
| CV cc/10 g | 35.7 | 38.0 |
| OV % | 12.9 | 12.9 |

These results show an increase in filling power of about 6.5%.

EXAMPLE 6

The same tobacco filler used in Example 1 was treated with 3% calcium acetate, the results being as follows:

| | Control | Experimental |
|---|---|---|
| CV | 35.50 | 39.90 |
| OV | 13.04 | 12.79 |

These results show an increase in filling power of about 12.4%.

EXAMPLE 7

As in Example 1, a cigarette tobacco blend was treated with magnesium sulfate comprising 3% of the blend weight. When compared with the control, these results were observed.

| | Control | Experimental |
|---|---|---|
| CV | 37.00 | 40.30 |
| OV | 13.55 | 12.70 |

Roughly about 8% more cigarettes could be prepared from the tobacco treated with magnesium sulfate due to an increase of filling power approximating 9.0%.

EXAMPLE 8

In a similar manner to Example 1, a cigarette tobacco filler treated with 3% by weight of ferrous sulfate resulted in a comparable increase in filling power.

EXAMPLE 9

In a similar manner to Example 1, a cigarette blend was treated with calcium sulfamate comprising 3% of the blend weight which also resulted in a comparable filling power increase.

In the following examples 10–13, experiments were conducted with various three percent addition salt solutions to treat a control tobacco, the results of which were compared to the untreated control tobacco.

EXAMPLE 10

| | CV | OV |
|---|---|---|
| 3% Potassium Titanium Oxalate on Control $K_2TiO(C_2O_4)_2 \cdot 2H_2O$ | 39.4 | 12.82 |
| Control | 35.5 | 13.04 |

These results illustrate an increase in filling power of approximately 10%.

EXAMPLE 11

| | CV | OV |
|---|---|---|
| 3% Tannic acid on control | 42.8 | 12.09 |
| Control | 37.2 | 12.97 |

These results illustrate an increase in filling power of approximately 15%.

EXAMPLE 12

| | CV | OV |
|---|---|---|
| 3% Ca-gluconate on control | 39.0 | 12.62 |
| Control | 37.2 | 12.97 |

These results illustrate an increase in filling power of 4 to 5%.

EXAMPLE 13

| | CV | OV |
|---|---|---|
| 3% $(NH_4)_2Mg(SO_4)_2 \cdot 6H_2O$ | 40.5 | 12.75 |
| Control | 37.2 | 12.97 |

These results show an increase in filling power of about 8%.

EXAMPLE 14

A combination of aluminum citrate, 1% by dry weight of the tobacco, and citric acid, 2% by dry weight of the tobacco were found to cause only an increase in filling power of about 2% to 4%.

It will be apparent to those skilled in the art that various modifications and variations of the invention of the preceeding disclosure may be made without departing from the spirit and scope thereof. It will be understood, therefore, that the claims hereinafter set forth should be limited only by such limitations as expressly set forth.

I claim:

1. A method of increasing the filling power of tobacco comprising:

applying to said tobacco a solution of a multivalent salt and a solvent wherein said solvent causes said tobacco to expand and wherein said salt so applied constitutes from 0.2% to 7.5% by dry weight of said tobacco to be expanded; and drying said expanded tobacco to remove solvent therefrom, said salt causing pectinaceous substances of said tobacco to retain said tobacco in expanded form.

2. The method of claim 1 wherein said salt so applied constitutes from 1% to 4% by dry weight of said tobacco to be expanded.

3. The method of claim 1 wherein said salt constitutes 3% by dry weight of said tobacco to be expanded.

4. The method of claim 1 wherein said salts are selected from the group of organic acid salts consisting of calcium acetate, calcium gluconate, calcium levulinate, aluminum citrate, potassium titanium oxalate, individually and in combinations thereof.

5. The method of claim 4 wherein said salts constitute from 1% to 4% by dry weight of said tobacco to be expanded.

6. The method of claim 4 wherein said salts constitute 3% by dry weight of said tobacco to be expanded.

7. The method of claim 1 wherein said multivalent salts are selected from the group of multivalent metal salts consisting of aluminum sulfate, potassium aluminum sulfate, ammonium aluminum sulfate, magnesium sulfate, diammonium magnesium sulfate and ferrous sulfate, individually and in combinations thereof.

8. The method of claim 7 wherein said salts constitute 1% to 4% by dry weight of said tobacco to be expanded.

9. The method of claim 7 wherein said salts constitute 3% by dry weight of said tobacco to be expanded.

10. The method of claim 1 wherein said multivalent salts are selected from the group consisting of hydrates of said multivalent salts.

11. The method of claim 10 wherein said salts constitute 1% to 4% by dry weight of said tobacco to be expanded.

12. The method of claim 10 wherein said salts constitute 3% by dry weight of said tobacco to be expanded.

13. The method of claim 10 wherein said salts are selected from the group of hydrated salts consisting of $Al_2(SO_4)3.18H_2O$, $KAl(SO_4)_2.12H_2O$, $NH_4.Al(SO_4)_2.12H_2O$ and $K_2TiO(C_2O_4)_2.2H_2O$, individually and in combinations thereof.

14. The method of claim 13 wherein said hydrated salts, individually and in combinations thereof, comprise from 1% to 4% by dry weight of said tobacco to be expanded.

15. The method of claim 13 wherein said hydrated salts, individually or in combination, comprise 3% by dry weight of said tobacco to be expanded.

16. The method of claim 10 wherein said hydrate salt is aluminum sulfate in hydrated form.

17. The method of claim 16 wherein said hydrated aluminum sulfate constitutes 1% to 4% by dry weight of said tobacco to be expanded.

18. The method of claim 16 wherein said hydrated aluminum sulfate constitutes 3% by dry weight of said tobacco to be expanded.

19. The method of claim 1 wherein said salt is a salt of a multivalent metal cation selected from the group consisting of cations of aluminum, calcium, magnesium, titanium, zinc, chromium, manganese, molybdenum, nickel, and tin individually and in combinations thereof.

20. The method of claim 19 wherein said salts, individually and in combinations thereof, comprise from 1% to 4% by dry weight of said tobacco to be expanded.

21. The method of claim 19 wherein said salts, individually and in combinations thereof, comprise 3% by dry weight of said tobacco to be expanded.

22. The method of claim 1 wherein said salt is a salt of an organic acid anion selected from the group consisting of said anions of citric, lactic, oxalic, succinic, malonic, malic, tartaric, adipic, glycolic, fumaric, ascorbic, aspartic, glutamic, tannic and gallic acids, individually and in combinations thereof.

23. The method of claim 22 wherein said salts, individually and in combinations thereof, comprise 1% to 4% by dry weight of said tobacco to be expanded.

24. The method of claim 23 wherein said salts, individually and in combinations thereof, comprise 3% by dry weight of said tobacco to be expanded.

25. An improved tobacco filler of expanded shredded tobacco wherein the improvement comprises expanded pectinaceous substances of said tobacco bound by multivalent salts, consisting 0.2% to 7.5% by dry weight of said tobacco filler, selected from the group consisting of aluminum sulfate, magnesium sulfate, diammonium magnesium sulfate, potassium aluminum sulfate, aluminum citrate, calcium acetate, calcium levulinate, calcium sulfamate and calcium gluconate individually and in combinations thereof, to retain said expansion.

26. The improved tobacco filler of claim 25 wherein said salts comprise from 1% to 4% by dry weight of said tobacco filler.

27. The improved tobacco filler of claim 25 wherein said salts comprise 3% by dry weight of said tobacco filler.

28. The improved tobacco filler of claim 25 wherein said salts are hydrated salts $Al_2(SO_4)_3.18H_2)$, $KAl(SO_4)_2.12H_2O$, $NH_4Al(SO_4)_2.12H_2O$ and $K_2TiO(C_2O_4)_2.2H_2O$.

29. An improved, uniformly treated expanded tobacco filler of blended, shredded tobacco constituents wherein the improvement comprises expanded pectinacious materials of said filler constituents bound by at least one salt, consisting of 0.2% to 7.5% by dry weight of said tobacco filler, selected from the group consisting of $Al_2(SO_4)_3.18H_2O$, $KAl(SO_4)_2.12H_2O$, $NH_4Al(SO_4)_2.12H_2O$, $K_2TiO(C_2O_4)_2.2H_2O$ and $Ca(CH_3COO)_2$ to retain said expansion.

30. The improved tobacco filler of claim 29 wherein said salt constitutes 1% to 4% by dry weight of said tobacco filler.

31. The improved tobacco filler of claim 29 wherein said salt constitutes 3% by dry weight of said tobacco filler.

32. An improved tobacco filler of expanded shredded tobacco wherein the improvement comprises expanded pectinaceous substances of said tobacco bound by calcium acetate constituting 0.2% to 7.5% by dry weight of said tobacco filler.

33. The improved tobacco filler of claim 32 wherein said calcium acetate comprises 1% to 4% by dry weight of said tobacco to be expanded.

34. The improved tobacco filler of claim 32 wherein said calcium acetate comprises 3% by dry weight of said tobacco to be expanded.

* * * * *

UNITED STATES PATENT AND TRADEMARK OFFICE

CERTIFICATE OF CORRECTION

PATENT NO. : 4,274,427

DATED : June 23, 1981

INVENTOR(S) : Andrew T. Lendvay

It is certified that error appears in the above-identified patent and that said Letters Patent are hereby corrected as shown below:

Column 4, line 17 after "salt" add ---of---.

Column 10, line 37 (claim 28) change "$18H_2$)" to ---$18H_2O$---.

Signed and Sealed this

*Twentieth* Day of *October 1981*

[SEAL]

*Attest:*

GERALD J. MOSSINGHOFF

*Attesting Officer*

*Commissioner of Patents and Trademarks*